US005718128A

United States Patent [19]

Lonati et al.

[11] Patent Number: 5,718,128

[45] Date of Patent: Feb. 17, 1998

[54] DOUBLE-CYLINDER CIRCULAR KNITTING MACHINE FOR HOSIERY AND THE LIKE, WITH IMPROVED NEEDLE ACTUATION

[75] Inventors: Francesco Lonati; Tiberio Lonati; Ettore Lonati; Fausto Lonati, all of Brescia, Italy

[73] Assignee: Matec S.r.l., Scandicci, Italy

[21] Appl. No.: 753,977

[22] Filed: Dec. 4, 1996

[30] Foreign Application Priority Data

Dec. 20, 1995 [IT] Italy ..... MI95A2694

[51] Int. Cl.[6] ..... D04B 9/10

[52] U.S. Cl. ..... 66/14; 66/8; 66/13

[58] Field of Search ..... 66/13, 14

[56] References Cited

U.S. PATENT DOCUMENTS

| | | | |
|---|---|---|---|
| 1,437,109 | 11/1922 | Kelley | 66/14 |
| 1,852,256 | 4/1932 | Nobst et al. | 66/14 |
| 1,929,075 | 10/1933 | Nobst et al. | 66/14 |
| 2,327,398 | 8/1943 | Bromley et al. | 66/14 |
| 2,366,405 | 1/1945 | Holmes et al. | 66/14 |
| 2,375,475 | 5/1945 | Holmes et al. | 66/14 |

*Primary Examiner*—John J. Calvert

*Attorney, Agent, or Firm*—Albert Josif; Guido Modiano; Daniel J. O'Byrne

[57] ABSTRACT

Double-cylinder circular knitting machine for hosiery or the like. The machine comprises a lower needle cylinder having a substantially vertical axis and an upper needle cylinder that is arranged above and coaxially with respect to the lower needle cylinder. A plurality of axial grooves is formed in the skirt of the needle cylinders and each groove accommodates a double-beak needle that can move axially along the corresponding groove. In each one of the grooves there is a lower pusher, which is arranged below the needle and faces the lower head of the needle with its upper end, and an upper pusher, which is arranged above the needle and faces the upper head of the needle with its lower end. Cams are provided for the actuation of the lower pushers and of the upper pushers to make them slide upwards or downwards in their respective grooves to push up or down the interposed needles located in the lower or in the upper needle cylinder or to transfer the needles from the lower to the upper needle cylinder or vice versa.

13 Claims, 4 Drawing Sheets

DOUBLE-CYLINDER CIRCULAR KNITTING MACHINE FOR HOSIERY AND THE LIKE, WITH IMPROVED NEEDLE ACTUATION

BACKGROUND OF THE INVENTION

The present invention relates to a double-cylinder circular knitting machine for hosiery or the like.

It is known that double-cylinder knitting machines for hosiery have a lower needle cylinder, which has a substantially vertical axis, and an upper needle cylinder, which is arranged in an upward region and coaxially with respect to the lower needle cylinder. A plurality of axial grooves is formed in the skirt of the needle cylinders, and each groove accommodates a double-beak needle, which can move axially along the corresponding groove.

The needles are actuated by virtue of adapted elements, known as sliders, which are arranged in the grooves of the needle cylinders below and above the needles.

More particularly, a lower slider is arranged in each groove of the lower needle cylinder below the needle, whilst an upper slider is arranged in each groove of the upper needle cylinder above the needle.

The end of the sliders that is directed towards the overlying or underlying needle has a particular shape, with a lug and a hook that engages the lower or upper beak of the needle. A shoulder is provided below the hook of the lower sliders and above the hook of the upper sliders and engages respectively the lower head of the needle and the upper head of the needle.

When the needles are arranged in the lower needle cylinder, i.e., when their upper beak is arranged in the region between the lower needle cylinder and the upper needle cylinder, they form plain stitches, whilst when they are arranged in the upper needle cylinder and their lower beak is arranged at the region between the lower needle cylinder and the upper needle cylinder, they form purl stitches.

In conventional double-cylinder circular machines, the movement of the needles is actuated by means of the sliders, which have heels protruding radially from the needle cylinders and engaging cams that face the skirt of the needle cylinder and delimit paths for the heels of the sliders, so as to achieve the reciprocating actuation of the sliders and therefore of the needle that is engaged with said sliders to form the stitch.

In practice, when the needles are arranged in the lower needle cylinder, their lower beak is engaged with the hook of the lower sliders, which transfer to the needle both the rising motion and the lowering motion that is imparted to said sliders by the corresponding actuation cams, whilst when the needles are arranged in the upper needle cylinder, their upper beak is engaged by the hook of the upper sliders, which transfer to the needle the motion produced by their engagement with the corresponding actuation cams.

When a needle must be transferred from the lower needle cylinder to the upper needle cylinder, i.e., when it must switch from plain knitting to purl knitting, the corresponding lower slider is raised so as to push the overlying needle into the upper cylinder, whilst the upper slider is pushed downwards until it engages the upper beak of the needle with its hook. When lifting ends, the lower slider engages, with its upper end or lug, an abutment that causes its oscillation towards the outside of the lower needle cylinder, so as to disengage its hook from the lower beak of the needle.

In this manner, the needle remains hooked to the upper slider and is actuated by it both in the rising motion and in the descending motion during the formation of the knitting.

In double-cylinder circular machines, the needles are therefore actuated by the lower sliders when they are in the lower needle cylinder and by the upper sliders when they are in the upper needle cylinder. The sliders that are engaged with the corresponding needle apply to said needle a pushing or pulling action so as to cause the reciprocating motion of the needle along the corresponding groove of the needle cylinders during the formation of the knitting.

One of the problems that is still unsolved in double-cylinder circular machines is the complexity of the movements required to achieve the engagement and disengagement of the sliders with respect to a beak of the needle. This movement in fact entails both the sliding of the sliders along the corresponding groove of the needle cylinder and an outward oscillation of said sliders making the sliders protrude with one of their portions radially from the needle cylinder proximate to the region lying between the two cylinders.

The complexity of these movements requires a reduction in the rotation rate of the needle cylinders during the transfer of the needles from the lower cylinder to the upper cylinder or vice versa.

Furthermore, since the sliders protrude radially in the region that lies between the two needle cylinders during the transfer operation, particular care is required in setting the position of the so-called "fish cams", i.e., of the cams that keep the tabs of the needles open upstream of each thread feed, to avoid interference between the sliders and said cams.

Furthermore the particular movement that must be imparted to the sliders requires a considerable angular space for the arrangement of the various cams that actuate the sliders at the feed or drop where the needles are transferred from the lower cylinder to the upper cylinder or vice versa.

Another problem is constituted by the stresses to which the beaks of the needles engaged by the sliders are subjected. These stresses are the primary cause of frequent breakages of needles, which force to stop the machine in order to replace them.

SUMMARY OF THE INVENTION

The aim of the present invention is to solve the above problems by providing a double-cylinder circular knitting machine for hosiery or the like, wherein the actuation of the needles and the transfer from the lower needle cylinder to the upper needle cylinder are considerably simplified.

Within the scope of this aim, an object of the invention is to provide a double-cylinder circular machine that significantly reduces the stresses to which the needles are subjected, so as to achieve a longer life for said needles.

Another object of the invention is to provide a double-cylinder circular machine which can transfer the needles from the lower cylinder to the upper cylinder without necessarily requiring a reduction of actuation speed of the machine.

Another object of the invention is to provide a double-cylinder circular machine that safely avoids any interference of the needles and of the elements meant to actuate them with the fish cams arranged around the skirt of the needle cylinders.

This aim, these objects, and others, which will become apparent hereinafter, are achieved by a double-cylinder circular knitting machine for hosiery or the like, which comprises a lower needle cylinder that has a substantially vertical axis and an upper needle cylinder arranged above and coaxially with respect to said lower needle cylinder, a plurality of axial grooves being formed in the skirt of said needle cylinders, each groove accommodating a double-beak needle that can move axially along the corresponding groove, characterized in that it comprises, in each one of said grooves, a lower pusher, which is arranged below the needle and faces the lower head of the needle with its upper end, and an upper pusher, which is arranged above the needle and faces the upper head of the needle with its lower end, means being provided for the actuation of the lower pushers and of the upper pushers to make them slide upwards or downwards in their respective grooves to push up or down the interposed needles located either in the lower needle cylinder or in the upper needle cylinder or to transfer the needles from the lower needle cylinder to the upper needle cylinder or vice versa.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
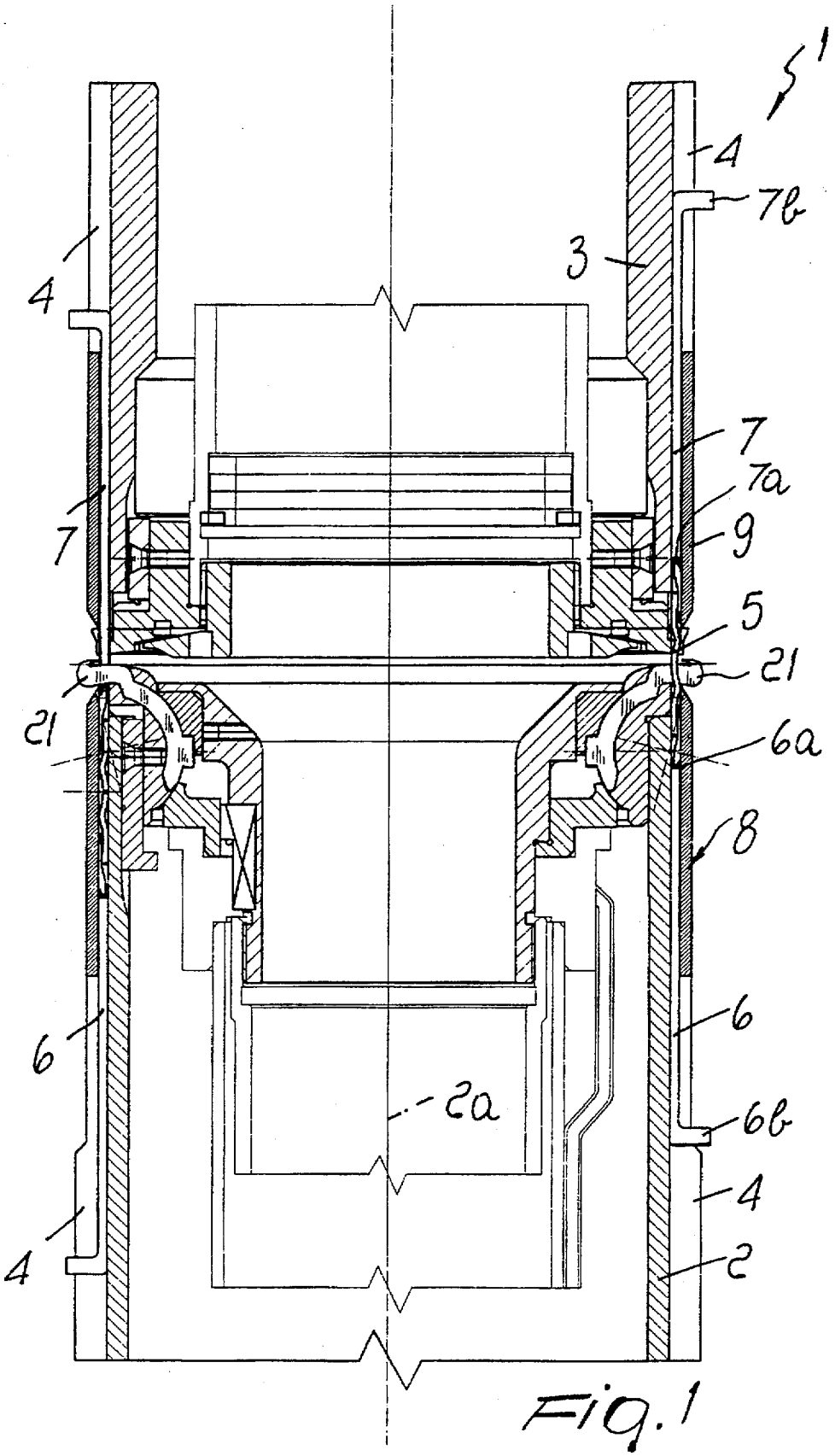
FIG. 1 is a schematic axial sectional view of a double-cylinder circular machine according to the invention.
Figure 2:
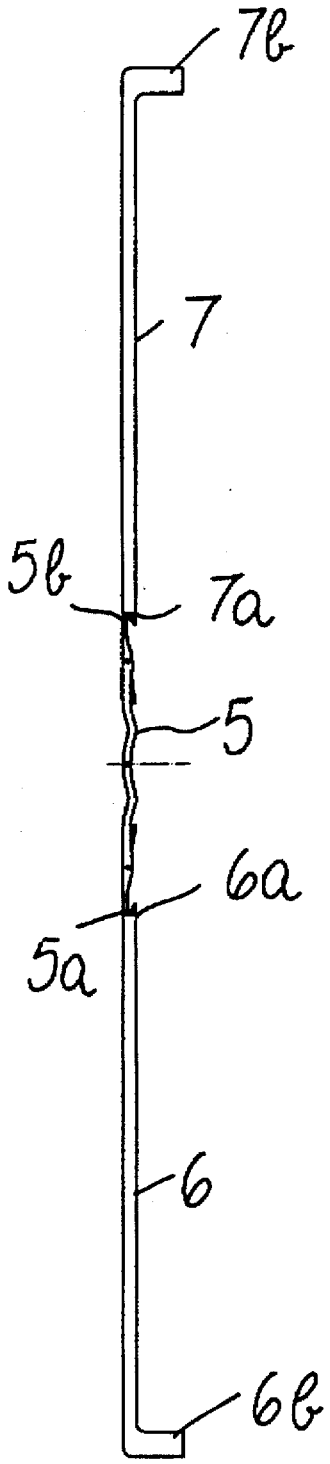
FIG. 2 is a view of a needle of the machine according to the invention, with a lower pusher and an upper pusher for its actuation arranged so as to face each other.

With reference to the above figures, the machine according to the invention, generally designated by the reference numeral 1, comprises, in a per se known manner, a lower needle cylinder 2, which is arranged so that its axis 2*a* is substantially vertical.

An upper needle cylinder 3 is arranged above and coaxially with respect to the lower needle cylinder 2.

A plurality of axial grooves 4 is formed in the skirt of the needle cylinders 2 and 3, and each groove accommodates a double-beak needle 5 that can move axially along the corresponding groove 4.

According to the invention, in each groove 4 there is a lower pusher 6, which is arranged below the needle 5 and faces the lower head 5*a* of the needle 5 with its upper end 6*a*, and there is an upper pusher 7, which is arranged above the needle 5 and faces, with its lower end 7*a*, the upper head 5*b* of the needle 5.

Actuation means act on the lower pushers 6 and on the upper pushers 7 and cause their upward or downward movement inside the corresponding groove 4 so as to push upwards or downwards the interposed needles 5 both when they are arranged in the lower cylinder 2 and when they are arranged in the upper cylinder 3, or to transfer the needles from the lower cylinder 2 to the upper cylinder 3 or vice versa.

More particularly, the pushers 6 and 7 are provided, proximate to their end that lies opposite to the needle 5, with a heel 6*b* and 7*b* protruding from the corresponding groove 4 of the needle cylinders 2 and 3 so as to engage cams that laterally face the skirt of the needle cylinders 2 and 3 and form paths for said heels 6*b* and 7*b* with rising and descending portions, so as to cause the upward or downward movement of the pushers 6 and 7 as a consequence of a relative rotary motion of the cylinders 2 and 3 about their own axis 2*a* with respect to the cams.

In practice, differently from conventional double-cylinder machines, a needle 5 is actuated by both pushers 6 and 7 both when it is in the lower cylinder 2 and when it is in the upper cylinder 3, and the action that is transmitted from the pushers to the needle is a simple pushing action.

This avoids the need for the pushers to engage the needle and therefore the need to achieve engagement and disengagement of the needle on the part of the pushers 6 and 7, which, in the machine according to the invention, are actuated exclusively with a movement that is parallel to the axis 2*a*.

The end 6*a* and 7*a* of the pushers 6 and 7 is conveniently flat, so as to form a resting surface for the lower head 5*a* or for the upper head 5*b* of the interposed needle 5, by means of which the force applied to the corresponding pusher is transmitted to the needle.

The pushers 6 and 7, except for the heel 6*b* and 7*b*, are contained within the radial space occupied by the needle cylinders 2 and 3.

By virtue of this fact, proximate to the upper end of the lower needle cylinder 2 and to the lower end of the upper needle cylinder 3 it is possible to arrange a cylindrical enclosure, respectively designated by the reference numerals 8 and 9, which has the purpose of protecting the needles 5 and of safely preventing their escape from the needle cylinders.

Figure 6:
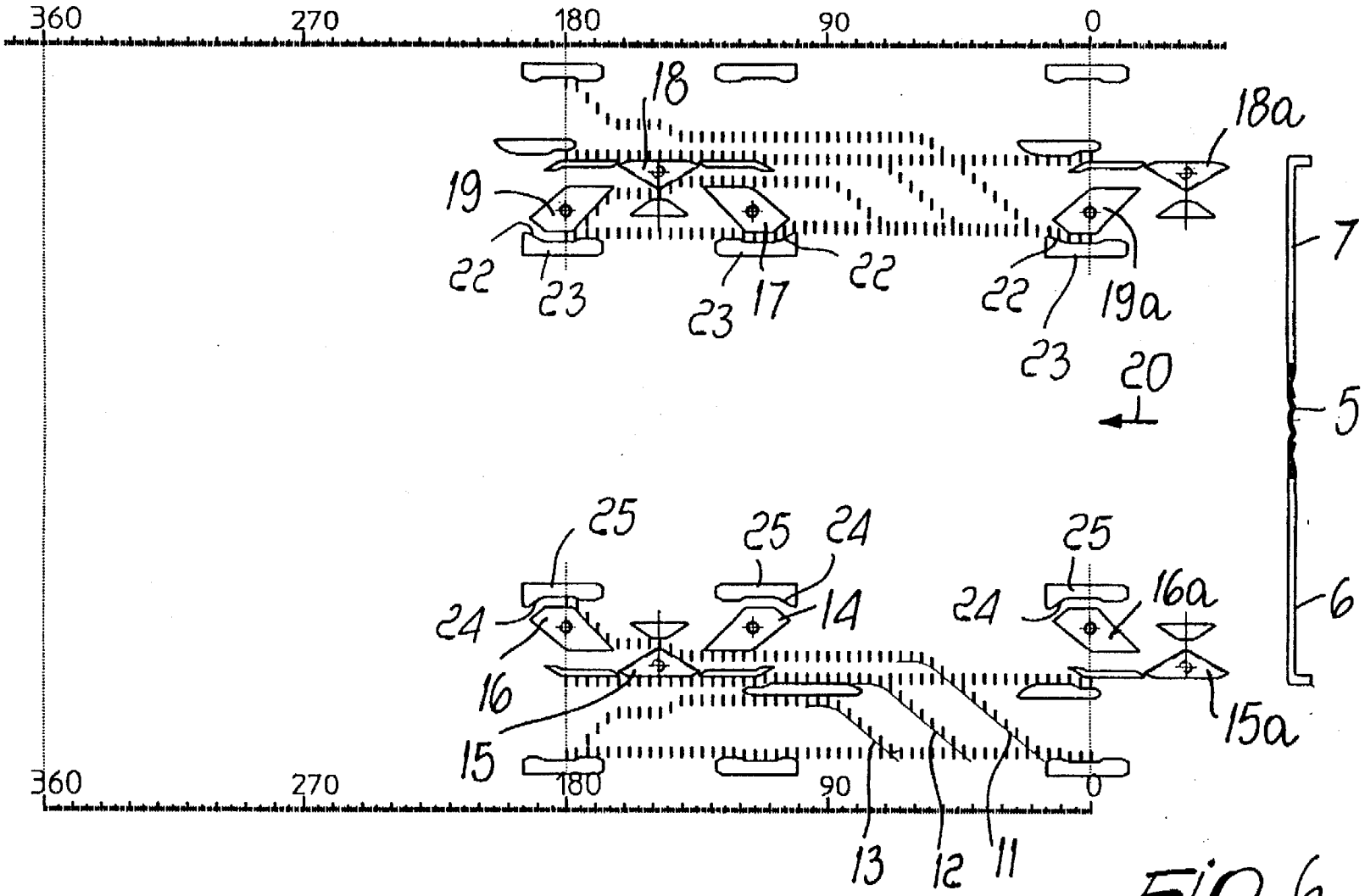
FIG. 6 is a schematic view of a portion of the skirt of the cams that actuate the pushers of the machine according to the invention.

FIG. 6 shows, merely by way of example, a portion of the actuation cans of the pushers for the double-cylinder circular machine according to the invention.

Below the lower pusher 6, in the corresponding groove 4, it is possible to arrange, in a per se known manner, selectors or jacks that select the needles that must knit at a given thread feed or the needles that must be transferred from the lower cylinder 2 to the upper cylinder 3 at the considered feed.

In order to perform this selection it is possible to use conventional selection devices in addition to conventional selectors or jacks.

In particular, as shown in FIG. 6, it is possible to obtain, by means of conventional selection device, the rise of the lower pushers 6 according to three ramps, designated by the reference numerals 11, 12, and 13 respectively, according to the various knitting requirements.

More particularly, the ramp 11 transfers the needles from the lower cylinder 2 to the upper cylinder 3; the ramp 12 keeps the pushers 6 and 7, and therefore the corresponding needles, in an inactive condition, while the ramp 13 moves the heel 6*b* of the lower pushers 6 and the heel 7*b* of the upper pushers 7 along paths that cause the actuation of the needle 5 in the lower cylinder.

Merely by way of example, in FIG. 6 the reference numerals 14, 15, and 16 designate the so-called knitting cams through which the pushers 6, and therefore the needles 5, are actuated so as to knit when they are in the upper cylinder 3, i.e., during the formation of purl knitting, whereas the reference numerals 17, 18, and 19 designate the knitting cams that actuate the movement of the needle when said needle is in the lower cylinder, i.e., during the formation of plain knitting.

It should be noted that the cams 14 and 17 are used to form knitting as an alternative to the cams 16 and 19 when the needle cylinders are actuated with a rotary motion that is opposite with respect to the motion indicated by the arrow 20 in FIG. 6.

The same figure shows other cams, designated by the reference numerals 15*a*, 16*a*, 18*a*, and 19*a*, which correspond to the cams 15, 16, 18, and 19 for the actuation of the needles at a previous or subsequent feed.

The same figure also shows other conventional cams or countercams that have not been designated by a reference numeral for the sake of simplicity.

As shown by FIG. 6, the angular cam space required to achieve the correct actuation of the needles in the machine according to the invention is substantially of 180°; this means that in a double-cylinder circular machine with two feeds according to the invention it is possible to perform needle selection at each one of the two feeds, differently from conventional double-cylinder machines which, by requiring a wider angular cam space for the actuation of the sliders that in turn actuate the needles, are unable to perform two different selections at the two feeds.

The operation of the double-cylinder circular machine according to the invention is as follows.

Figure 3:
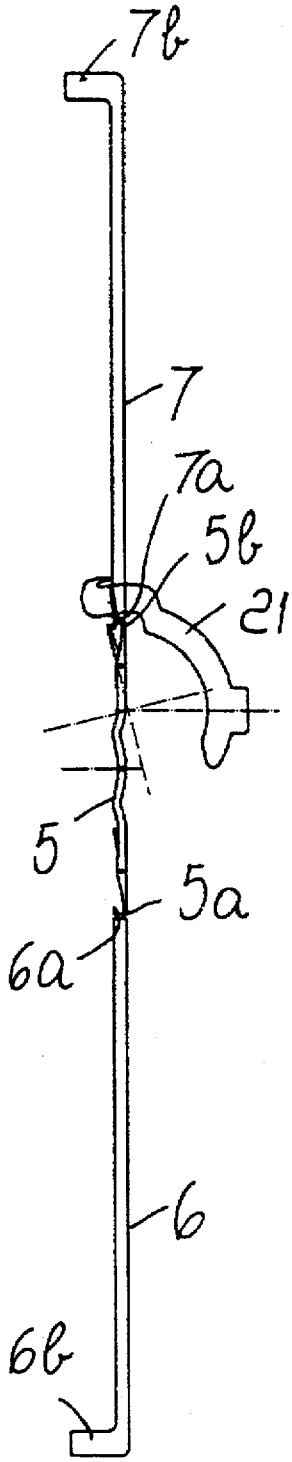
FIGS. 3 to 5 are schematic views of the movement of the needle during the formation of a plain stitch.
Figure 4:
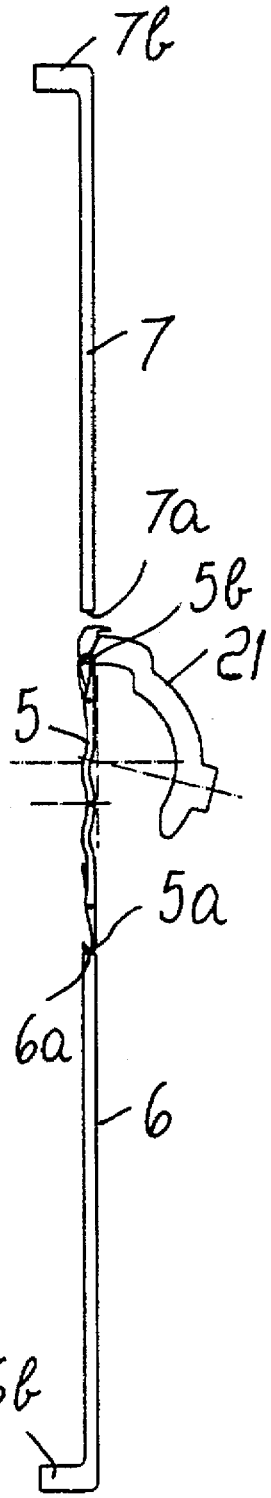
Figure 5:
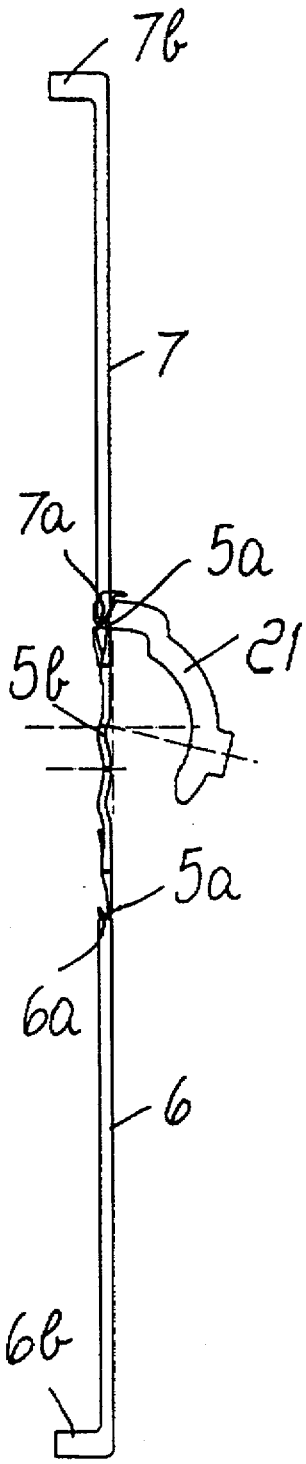

For the needles 5 arranged in the lower needle cylinder, the upward motion to move the upper beak of the needles into a position that is adapted to pick up the thread at the corresponding feed is achieved by virtue of the lifting of the lower pusher 6, whereas the subsequent lowering of the needles to form the loops of knitting is achieved by virtue of the lowering of the upper pusher 7, as shown in particular in FIGS. 3 to 5.

During the release of the previously formed loops, the upper pusher 7 is raised slightly, so that its lower end separates from the upper head of the underlying needle 5 in order to allow the correct release of the formed loops. The machine according to the invention is equipped in a per se known manner with sinkers 21 like conventional double-cylinder machines.

The lifting of the upper pushers 7 that allows the release of the previously formed loops can be performed by means of an adapted cam or, as shown, by providing an ascending portion 22 at the end of the countercams 23 that face the cams 19, 19*a*, and 17, which acts on the heel 7*b* of the upper pusher. For the same reason, a descending portion 24 is provided in the countercams 25 that face the cams 14, 16, and 16*a* for the lower pushers 6, so as to allow the release of the loops from the needles when said needles knit in the upper cylinder.

The movement of the needles arranged in the upper cylinder occurs in a manner that is similar to the one described with reference to the movement of the needles in the lower cylinder, i.e., in a manner similar to the rising motion of the needle actuated by the lower pusher 6 and the descending motion actuated by the upper pusher 7.

In practice it has been observed that the machine according to the invention fully achieves the intended aim, since a considerable simplification in the actuation of the pushers that actuate the needles is achieved because the needles are pushed by two mutually opposite pushers that do not engage the needle.

It should be noted that in the machine according to the invention, the needles are protected in any position by the cylindrical enclosures, safely preventing any interference of the needles with the cams arranged around the needle cylinders. By virtue of this fact, and by virtue of the fact that no engagement of the needles is required for their actuation, a longer needle life is achieved.

Furthermore, if fish cams are provided to keep the flaps of the needles open upstream of the feed at which they must pick up the thread, said cams can be arranged with less precision without causing problems in terms of interference with the needles.

The machine thus conceived is susceptible of numerous modifications and variations, all of which are within the scope of the inventive concept; furthermore all the details may be replaced with other technically equivalent elements.

In practice, the materials employed, as well as the dimensions, may be any according to the requirements and the state of the art.

What is claimed is:

1. A double-cylinder knitting machine for hosiery making, comprising:

a lower needle cylinder having a substantially vertical axis;

an upper needle cylinder being arranged above and coaxially with respect to said lower cylinder, said lower and upper cylinders including each a respective skirt thereof;

a plurality of axial grooves formed in said skirts of said cylinders;

a plurality of double-beak needles accommodated each in a corresponding groove of said plurality of grooves, said needles being axially movable along said grooves, and each of said needles including an upper and a lower head;

a plurality of non-rocking lower pushers, each lower pusher being arranged in a corresponding groove, below a corresponding needle, each of said lower pushers having an upper and a lower end, said upper end of said lower pushers facing the lower head of the corresponding needle;

a plurality of non-rocking upper pushers, each upper pusher being arranged in a corresponding groove above a corresponding needle, each of said upper pushers having a lower and an upper end, said lower end of said upper pushers facing the upper head of the corresponding needle; and actuation means for actuating the lower and upper pushers for upward and downward sliding movement along said grooves, said actuation means being arranged with respect to said upper and lower pushers, and said upper and lower pushers being arranged with respect to said needles, in a manner such that said pushers push up and down correspondingly interposed needles located in the lower and respectively in the upper cylinder for performing knitting, and such that said pushers transfer the needles from the lower to the upper cylinder and vice versa.

2. Machine according to claim 1, wherein said pushers have each at least one heel, said heel protruding radially from the corresponding groove of the lower and respectively upper needle cylinder, said actuation means comprising cams that laterally face the respective skirts of said needle cylinders, said cams forming paths for the heels of the lower pushers and for the heels of the upper pushers, with descending and ascending portions, said ascending and descending portions actuating said pushers for movement along the corresponding grooves of the needle cylinders as a consequence of a rotary motion of said needle cylinders about said vertical axis with respect to said cams for moving said needles to perform knitting with said needles and also for moving said needles to perform a transfer of said needles between said upper and lower cylinders.

3. Machine according to claim 2, wherein said pushers are contained within a radial space of said needle cylinders, with only said heels protruding outwards, and wherein said needles are completely contained within said radial space.

4. Machine according to claim 1, wherein the end of said pushers that is directed towards the corresponding needle is substantially flat.

5. Machine according to claim 2, wherein said pushers are movable, along the corresponding grooves of the needle cylinders, only in a direction that is parallel to said axis of the needle cylinders.

6. Machine according to claim 1, wherein said needle cylinders have, proximate to mutually facing ends thereof, cylindrical enclosures arranged inside the grooves that accommodate said needles and said pushers, and wherein said needles are completely contained within said cylindrical enclosures.

7. Machine according to claim 1 wherein said actuation means comprise heels of said pushers protruding radially from said grooves and cams arranged externally of said cylinders for engaging said heels, said cams comprising:

knitting cams for moving said pushers which correspondingly move said needles for performing knitting; and transfer cams for moving said pushers which correspondingly move said needles for transferring said needles between said upper and lower cylinders.

8. A double-cylinder knitting machine for hosiery making, comprising:

a lower needle cylinder having a substantially vertical axis;

an upper needle cylinder being arranged above and coaxially with respect to said lower cylinder, said lower and upper cylinders including each a respective skirt thereof;

a plurality of axial grooves formed in said skirts of said cylinders;

a plurality of double-beak needles accommodated each in a corresponding groove of said plurality of grooves, said needles being axially movable along said grooves, and each of said needles including an upper and a lower head;

a plurality of non-rocking lower pushers, each lower pusher being arranged in a corresponding groove, below a corresponding needle, each of said lower pushers having an upper and a lower end, said upper end of said lower pushers facing the lower head of the corresponding needle;

a plurality of non-rocking upper pushers, each upper pusher being arranged in a corresponding groove above a corresponding needle, each of said upper pushers having a lower and an upper end, said lower end of said upper pushers facing the upper head of the corresponding needle; and actuation device for actuating the lower and upper pushers for upward and downward sliding movement along said grooves, said actuation device being arranged with respect to said upper and lower pushers, and said upper and lower pushers being arranged with respect to said needles, in a manner such that said pushers push up and down correspondingly interposed needles located in the lower and respectively in the upper cylinder for performing knitting, and such that said pushers transfer the needles from the lower to the upper cylinder and vice versa.

9. Machine according to claim 8, wherein said pushers have each at least one heel, said heel protruding radially from the corresponding groove of the lower and respectively upper needle cylinder, said actuation device comprising cams that laterally face the respective skirts of said needle cylinders, said cams forming paths for the heels of the lower pushers and for the heels of the upper pushers, with descending and ascending portions, said ascending and descending portions actuating said pushers for movement along the corresponding grooves of the needle cylinders as a consequence of a rotary motion of said needle cylinders about said vertical axis with respect to said cams for moving said needles to perform knitting with said needles and also for moving said needles to perform a transfer of said needles between said upper and lower cylinders.

10. Machine according to claim 8 wherein said actuation device comprises heels of said pushers protruding radially from said grooves and came arranged externally of said cylinders for engaging said heels, said cams comprising:

knitting cams for moving said pushers which correspondingly move said needles for performing knitting; and transfer cams for moving said pushers which correspondingly move said needles for transferring said needles between said upper and lower cylinders.

11. A double-cylinder knitting machine comprising:

a lower needle cylinder rotatable about an axis;

an upper needle cylinder arranged coaxially with respect to said lower cylinder and rotatable with said lower needle cylinder about said axis;

a plurality of axial grooves formed in skirts of said cylinders;

a plurality of double needles slidably accommodated in said grooves, and each of said needles including an upper and a lower head;

a plurality of non-rocking lower pushers slidably arranged in said grooves below corresponding needles, each of said lower pushers having an upper and a lower end, said upper end of said lower pushers facing the lower head of a corresponding needle;

a plurality of non-rocking upper pushers slidably arranged in said grooves above corresponding needles, each of said upper pushers having a lower and an upper end, said lower end of said upper pushers facing the upper head of a corresponding needle; and actuation device for actuating the lower and upper pushers for upward and downward sliding movement in said grooves, said actuation device being arranged with respect to said upper and lower pushers, and said upper and lower pushers being arranged with respect to said needles, in a manner such that said pushers push up and down correspondingly interposed needles located in the lower and respectively in the upper cylinder for performing knitting, and such that said pushers transfer the needles between the lower to the upper cylinders.

12. Machine according to claim 11, wherein said pushers have each at least one heel, said heel protruding radially from the corresponding groove of the lower and respectively upper needle cylinder, said actuation device comprising cams that laterally face the respective skirts of said needle cylinders, said cams forming paths for the heels of the lower pushers and for the heels of the upper pushers, with descending and ascending portions, said ascending and descending portions actuating said pushers for movement along the corresponding grooves of the needle cylinders as a consequence of a rotary motion of said needle cylinders about said vertical axis with respect to said cams for moving said needles to perform knitting with said needles and also for moving said needles to perform a transfer of said needles between said upper and lower cylinders.

13. Machine according to claim 12 wherein said actuation device comprises heels of said pushers protruding radially from said grooves and cams arranged externally of said cylinders for engaging said heels, said cams comprising:

knitting cams for moving said pushers which correspondingly move said needles for performing knitting; and transfer cams for moving said pushers which correspondingly move said needles for transferring said needles between said upper and lower cylinders.

* * * * *